US012291389B2

(12) United States Patent
Taylor

(10) Patent No.: US 12,291,389 B2
(45) Date of Patent: May 6, 2025

(54) METHOD OF PACKING

(71) Applicant: Carol L. Taylor, Kansas City, MO (US)

(72) Inventor: Carol L. Taylor, Kansas City, MO (US)

( * ) Notice: Subject to any disclaimer, the term of this patent is extended or adjusted under 35 U.S.C. 154(b) by 9 days.

(21) Appl. No.: 18/110,739

(22) Filed: Feb. 16, 2023

(65) Prior Publication Data

US 2023/0278773 A1 Sep. 7, 2023

Related U.S. Application Data

(60) Provisional application No. 63/310,885, filed on Feb. 16, 2022.

(51) Int. Cl.
*B65B 11/00* (2006.01)
*B65B 5/04* (2006.01)
(Continued)

(52) U.S. Cl.
CPC ..... *B65D 81/127* (2013.01); *B65B 5/04* (2013.01); *B65B 11/00* (2013.01); *B65B 11/48* (2013.01); *B65B 21/245* (2013.01); *B65B 23/00* (2013.01); *B65B 55/20* (2013.01); *B65D 5/28* (2013.01); *B65D 65/38* (2013.01); *B65D 2203/12* (2013.01); *B65D 2565/384* (2013.01); *B65D 2581/053* (2013.01)

(58) Field of Classification Search
CPC ..... B65B 5/04; B65B 11/00; B65B 11/48; B65B 21/245; B65B 23/00; B65B 55/20; B65D 5/28; B65D 65/38; B65D 81/03; B65D 81/127; B65D 85/30; B65D 2585/30
USPC ..... 53/464, 472
See application file for complete search history.

(56) References Cited

U.S. PATENT DOCUMENTS 4,562,952 A * 1/1986 Chinman ..... A45C 3/00 53/429
4,753,650 A * 6/1988 Williams ..... A61F 13/58 604/389
(Continued)

FOREIGN PATENT DOCUMENTS

JP 2003024379 A * 1/2003
JP 2005052219 A * 3/2005

OTHER PUBLICATIONS

"Diapering Wine." Finding my Aloha.blogspot.com, https://findingmyaloha.blogspot.com/2010/07/diapering-wine.html, Jul. 23, 2010, 3 pages. (Year: 2010).*
(Continued)

*Primary Examiner* — Stephen F. Gerrity
(74) *Attorney, Agent, or Firm* — Law Office of Mark Brown, LLC; Christopher M DeBacker

(57) ABSTRACT

A packing system for safely packing fragile household item for moving or storage. The packing system provides a number of packing devices which include a pair of ends bridged by a central portion, and a pair of elastic skirts along the central portion, all of which form a cup-like shape for receiving the fragile household item. A variety of sizes of the packing devices could be combined within a single kit. They could be color coded. An embodiment of the invention employs unused diapers as the packing devices. These could be donated or otherwise procured.

3 Claims, 9 Drawing Sheets

(51) Int. Cl.

| | |
|---|---|
| ***B65B 11/48*** | (2006.01) |
| ***B65B 21/24*** | (2006.01) |
| ***B65B 23/00*** | (2006.01) |
| ***B65B 55/20*** | (2006.01) |
| ***B65D 5/28*** | (2006.01) |
| ***B65D 65/38*** | (2006.01) |
| ***B65D 81/127*** | (2006.01) |

(56) References Cited

U.S. PATENT DOCUMENTS 6,138,832 A * 10/2000 Hunter et al. ..... B65D 71/508 206/577
8,636,710 B2 * 1/2014 Ellingson et al. .. A61F 13/5633 604/389
2003/0032933 A1 * 2/2003 Sayama ..... A61F 13/62 604/389
2004/0208959 A1 * 10/2004 Scalise ..... A23B 7/00 426/106
2005/0148976 A1 * 7/2005 Van Gompel et al. ..... A61F 13/513 604/385.01
2006/0069372 A1 * 3/2006 Chakravarty et al. ..... A61F 13/55115 604/385.02
2008/0011623 A1 * 1/2008 Seals ..... B65D 81/03 206/205
2020/0391924 A1 * 12/2020 Kohn et al. ..... B65D 81/03
2021/0168111 A1 * 6/2021 Park ..... G06Q 50/01
2023/0026101 A1 * 1/2023 Washington et al. ..... B65D 5/4266

OTHER PUBLICATIONS

"16 Fun and Practical Uses for Clean Diapers." Healthy Tipping Point a blog by Caitlin Boyle, https://www.healthytippingpoint.com/2015/04/16-fun-and-practical-uses-for-clean-diapers.html, Apr. 1, 2015, 35 pages. (Year: 2015).*
"My mom used diapers to wrap a glass bottle I had in my luggage." Reddit.com, https://www.reddit.com/r/lifehacks/comments/4pn6rl/my_mom_used_diapers_to_wrap_a_glass_bottle_i_had/, Jun. 24, 2016, 9 pages. (Year: 2016).*
"Wrap ornaments or delicate objects in diapers to protect from breaking." Pinterest.com, https://www.pinterest.com/pin/447474912951360337/, Mar. 29, 2017, 2 pages. (Year: 2017).*
"Pin by Alexandra Entwistle on Pranks | Funny, Huggies diapers, Bubble . . . " Pinterest.com, https://www.pinterest.com/pin/470415123562865389/, May 7, 2018, 2 pages. (Year: 2018).*
"How NOT to ship porcelain/ceramic." Reddit.com, https://www.reddit.com/r/Flipping/comments/lx7gd8/comment/gpo43ad/, Mar. 3, 2021, 8 pages. (Year: 2021).*
"Found the seller who uses adult diapers as packing material." Reddit.com, https://www.reddit.com/r/Mercari/comments/ly294n/found_the_seller_who_uses_adult_diapers_as/, Mar. 4, 2021, 5 pages. (Year: 2021).*

* cited by examiner

METHOD OF PACKING

CROSS-REFERENCE TO RELATED APPLICATION

This application claims priority in U.S. Provisional Patent Application No. 63/310,885 Filed Feb. 16, 2022, which is incorporated herein by reference.

BACKGROUND OF THE INVENTION

1. Field of the Invention

The present invention relates generally to a packing system and method for use thereof, and more specifically to a packing system employing unused diapers and customized packaging for fragile items.

2. Description of the Related Art

Packing of fragile items is required when moving to a new location. Generally, this requires packing and wrapping the fragile items with paper, bubble wrap, foam, or other suitable packing materials. This is meticulous and same-sized packing materials may not adequately function for items of varying shapes and sizes. What is needed is a simple packing system with variable packing components.

Heretofore there has not been available a system or method for a packing system with the advantages and features of the present invention.

BRIEF SUMMARY OF THE INVENTION

One embodiment of the present invention provides a system of recycling unused diapers and using them for packing smaller, fragile items during a move. Small, fragile items such as kitchen plates and glasses can be difficult to pack up using typical paper, foam, and bubble wraps because of varying shapes and sizes. Unused diapers come in varying sizes and colors. These diapers have a cup-like shape with corners that gather together making them ideal for wrapping small fragile items. The proper sized diaper can be selected to accommodate the varying sizes in the items. If the diapers have colors (e.g. pink and blue), those can be used to identify the item packaged within the diaper. This embodiment provides a way to recycle otherwise unused diapers which may be tossed in the garbage otherwise. The diapers may be modified slightly using color coding or other improvements prior to packing the diapers into a kit which allows the end user to select the varying sizes for packing their items.

A second embodiment of the present invention provides a packing device which is modeled after the shape and protection of a diaper, but which is formed from cheaper and more common materials. A foam or bubble-wrap body in a generally cup-like shape includes tabs for securing the ends and edges of the device around fragile items. These resemble the tabs on diapers. An elastic material is applied to the base of the cup-like shape which helps to gather up the packing device around the fragile item. Other materials could be used to form the body of the device, including stuffed material within an exterior skin or paper or cardboard.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. First Embodiment Packing System 2

Figure 1:
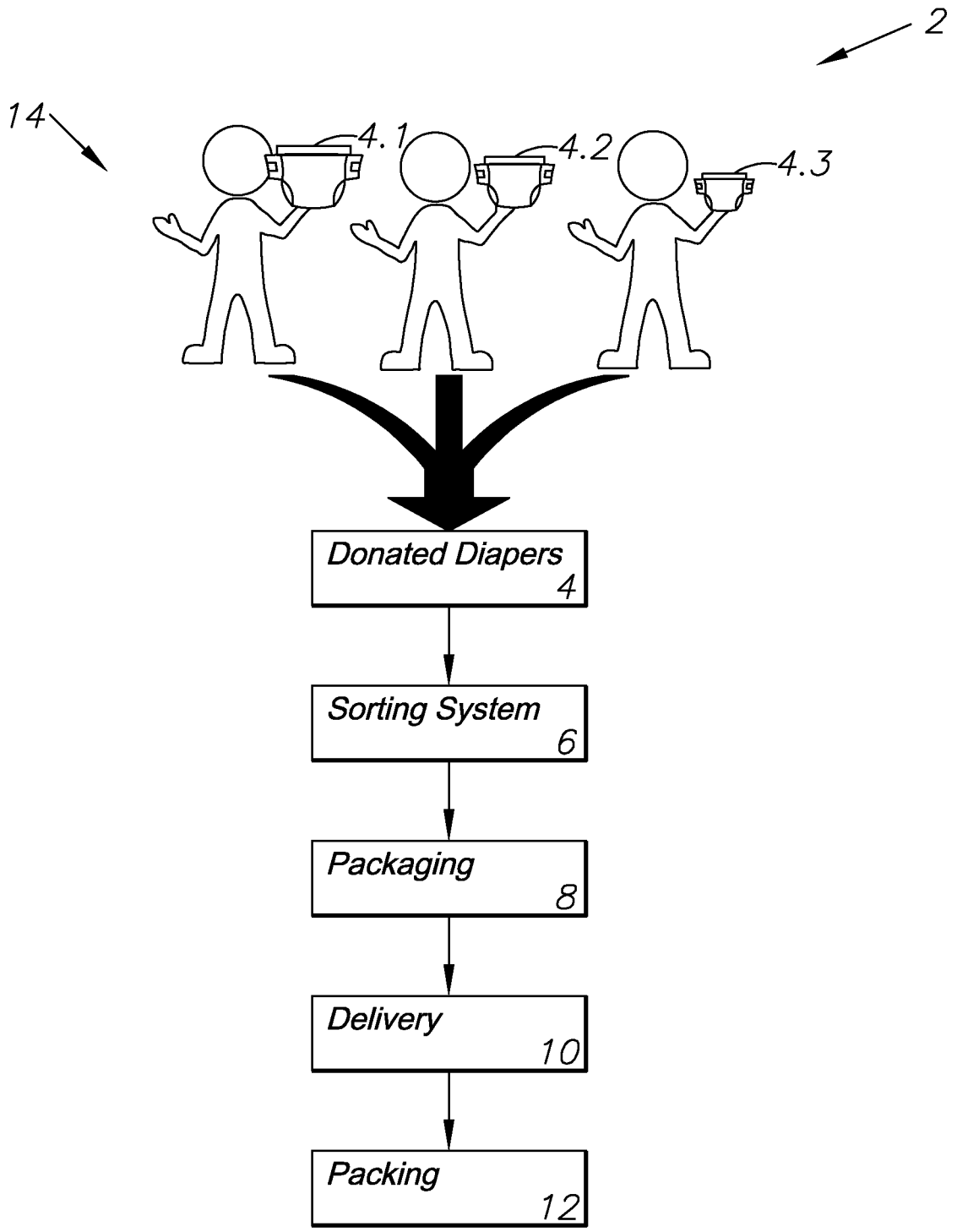
FIG. 1 is a diagram demonstrating the practicing of a packing system embodying the present invention by utilizing donated diapers as packing elements.
Figure 2:
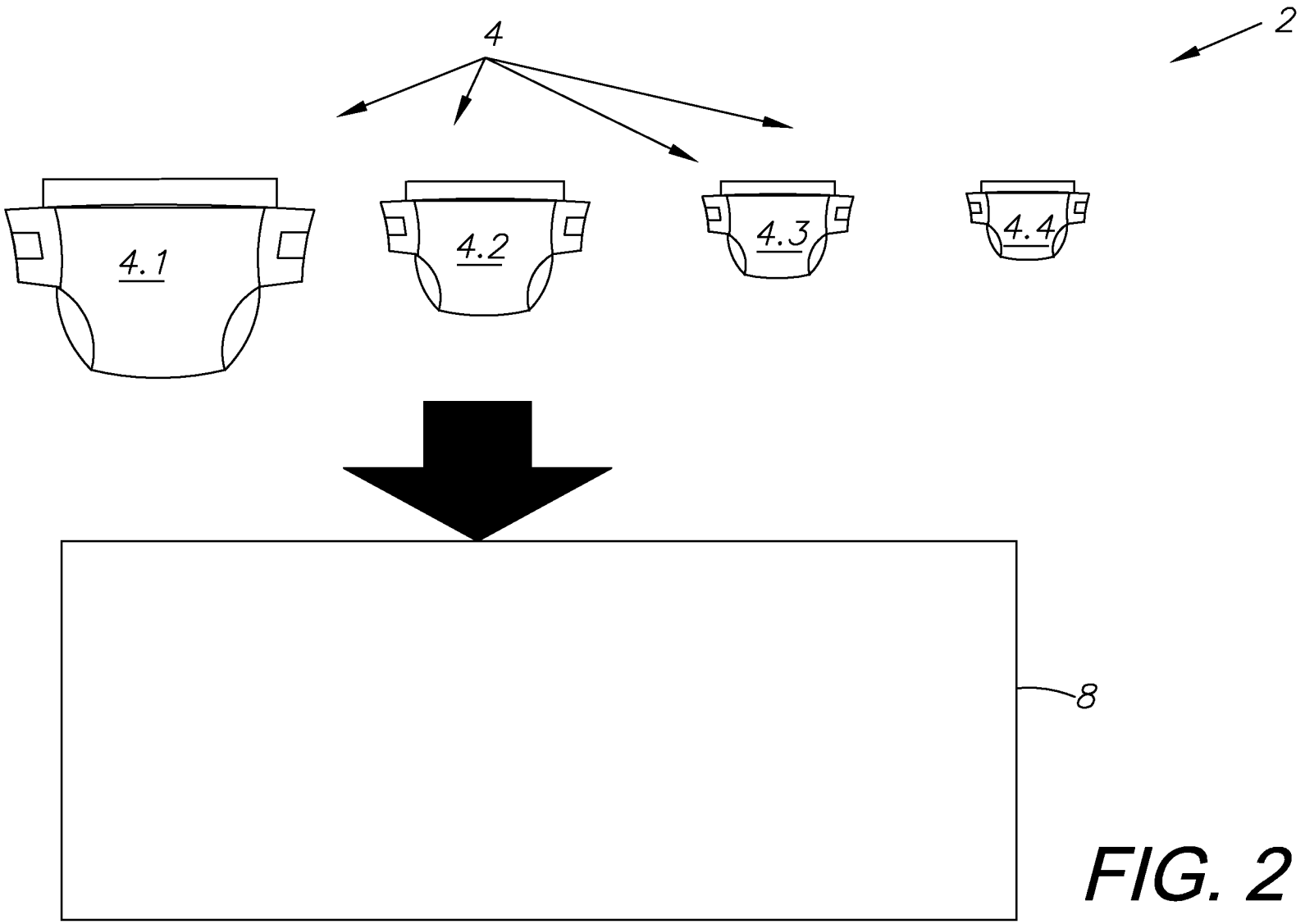
FIG. 2 is a diagrammatic representation of the embodiment thereof showing the packing of a variety of donated diaper sizes.
Figure 3:
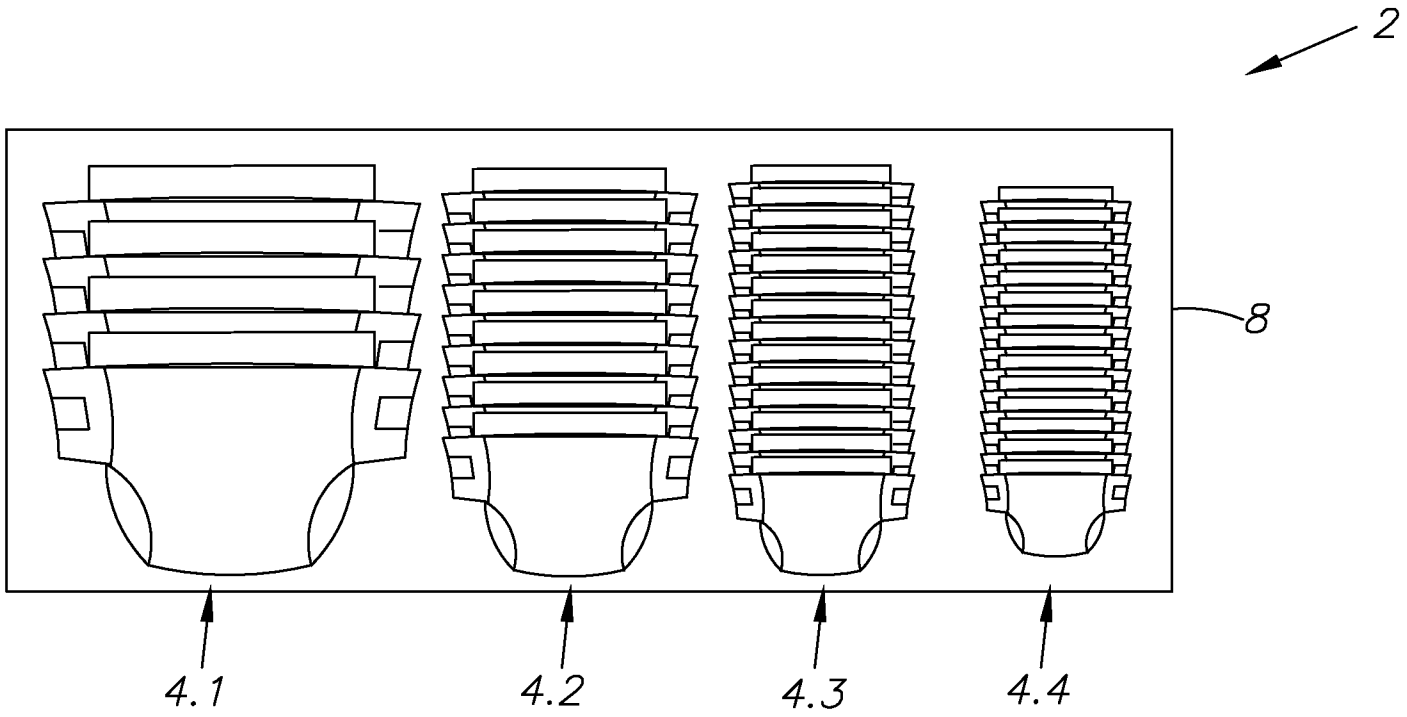
FIG. 3 is another diagrammatic representation of the embodiment thereof, showing a variety of packed diapers for packing.

FIGS. 1-3 show a packing system 2. Unused diapers 4 can be used for packing small, fragile items instead of being tossed out in the garbage. By collecting unused diapers 4 and separating them into kits, this provides a new, customizable packing system for packing up these small, fragile items. FIG. 1 demonstrates how donators 14 can discard their unused diapers of varying sizes 4.1, 4.2, 4.3, thereby becoming donated diapers 4. A sorting system 6 sorts the diapers by size, and then a packaging system 8 packages the donated diapers 4 of varying sizes into a final package for use by customers.

The sorting and packaging systems could be automated using conveyors, arms, sensors, and computers to identify the diapers by size, sort the diapers out into the packages, and physically pack the packages with a variety of diapers sizes.

Once packaged, the diapers can be delivered 10 to the end users, where they can be used for packing 12 fragile items, such as cups, plates, and glassware. The different sizes of the donated diapers 4 allow for the user to pack a variety of fragile items, selecting a diaper size appropriate for the items. As shown in FIGS. 2-3, the diapers of varying sizes would likely be provided in different quantities. There may not be a need for as many larger diapers, such as those identified as 4.1, whereas there would likely be a need for more of the smaller diapers 4.4. The overall kits can be customized by the end users or could include a standard inventory. A color-coding process could also be employed to help more quickly identify the various diaper sizes.

Figure 4:
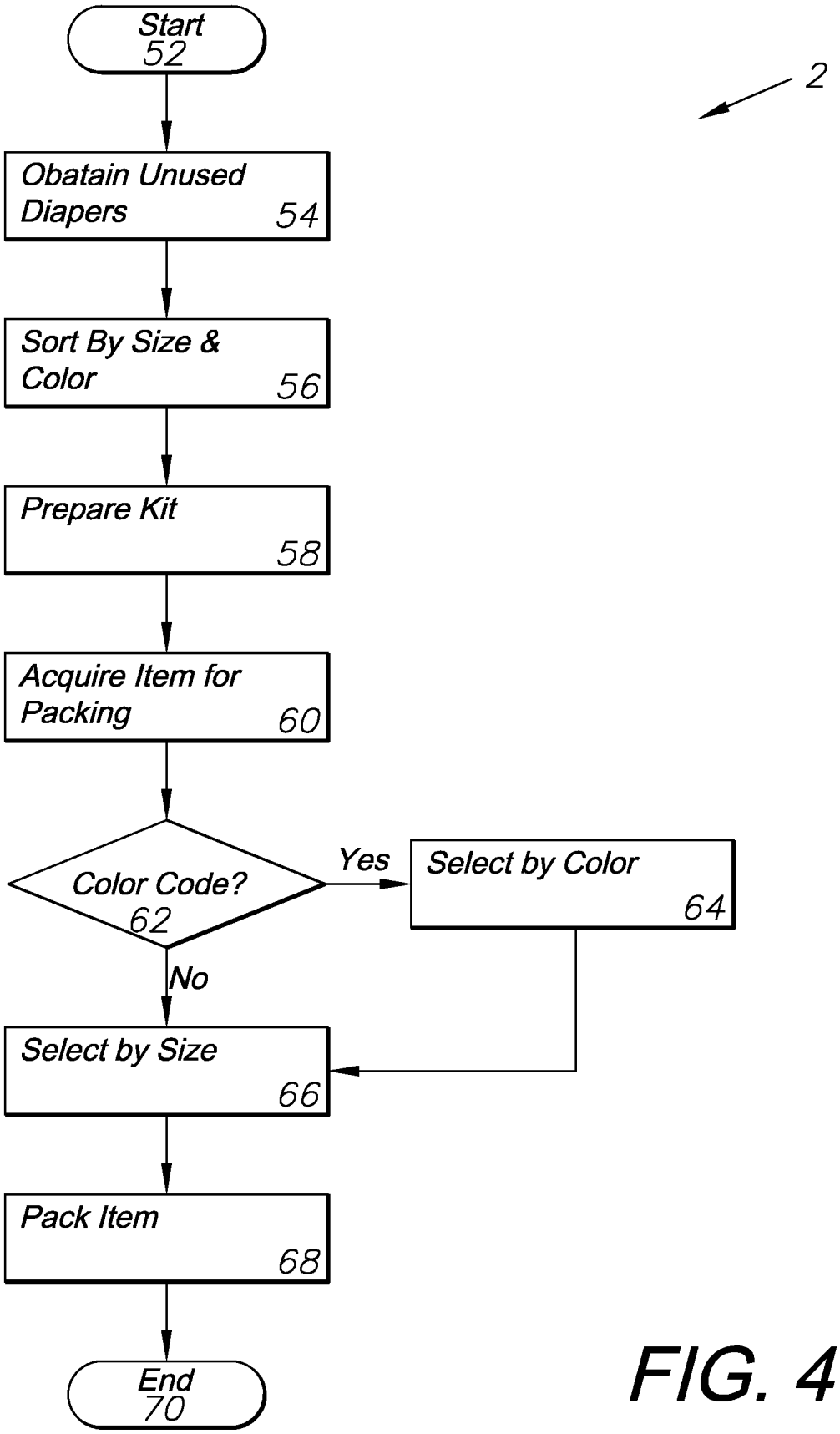
FIG. 4 is a flowchart diagramming the steps taken in practicing an embodiment of the present invention.
Figure 5:
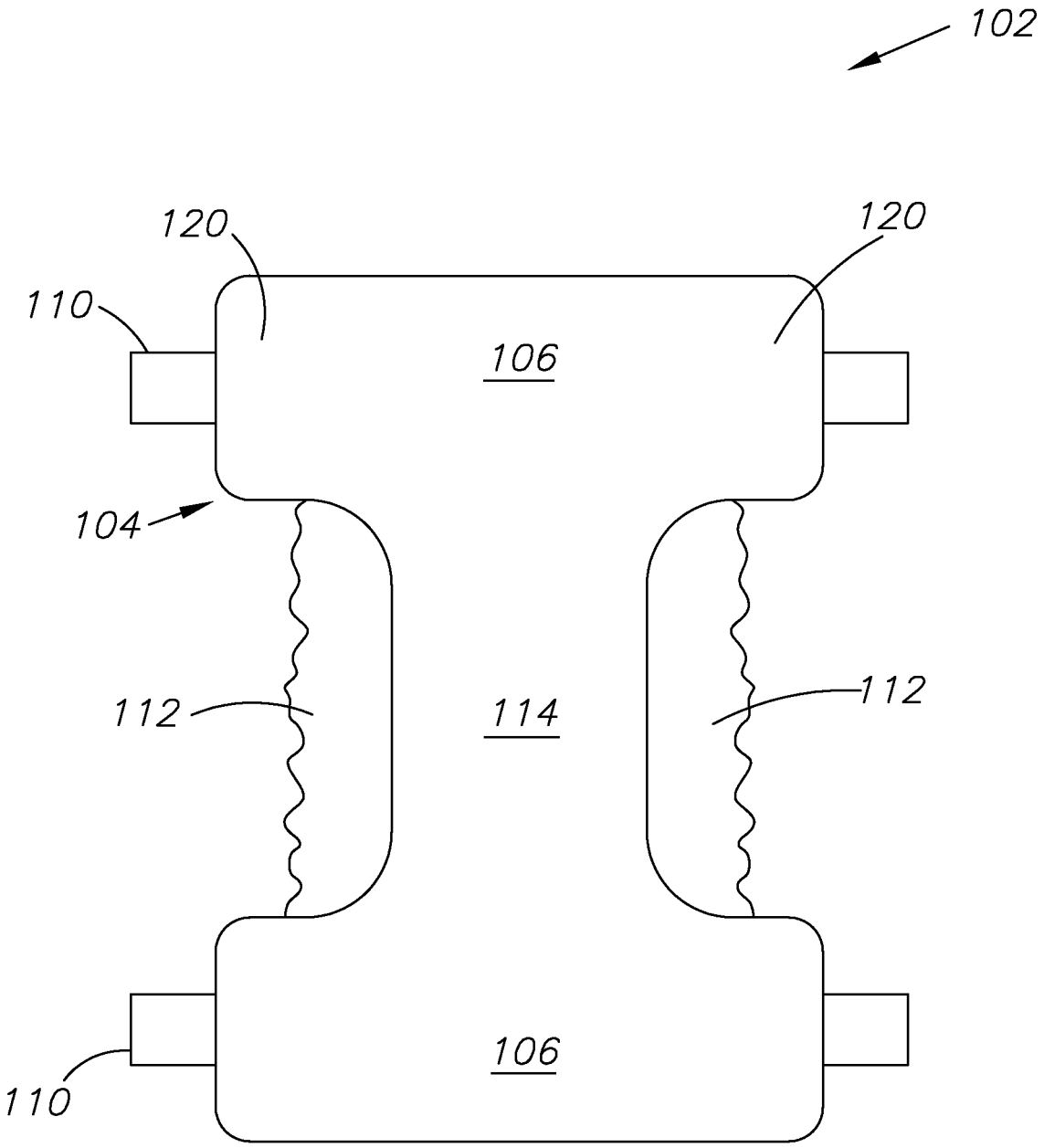
FIG. 5 is a top plan view of an alternative embodiment packing element which may be utilized alone or with the previous embodiment.
Figure 6:
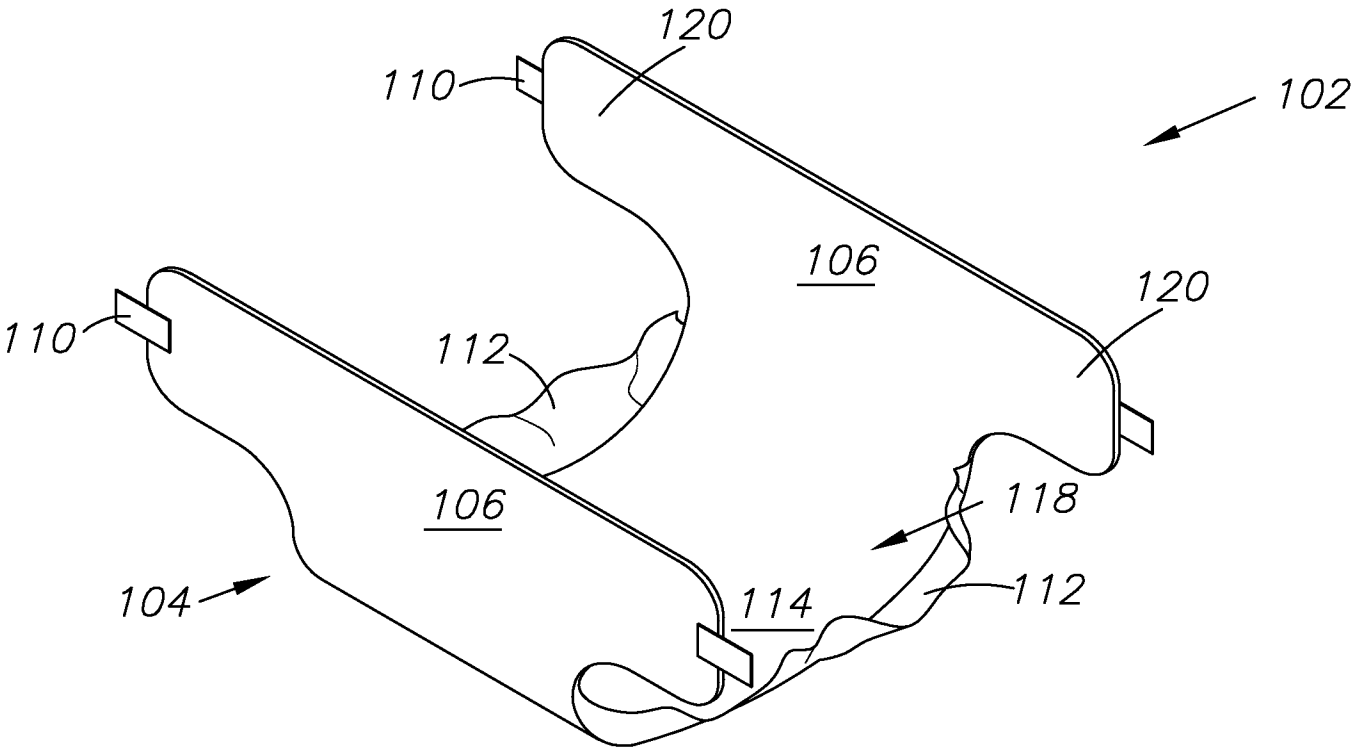
FIG. 6 is a three-dimensional isometric view thereof.

FIG. 4 shows the steps taken in practicing this embodiment. The process starts at 52 with the diapers being obtained at 54. This can be done by requesting donations for unused diapers or purchasing unused diapers.

The diapers are sorted by size and color at 56 and then are put into kits at 58. These kits would have varying sizes and may include varying colors. The end user would purchase or otherwise receive the kit for use in packing their items which are acquired at 60.

If the user wishes to color code the packing at 62, then they will select a diaper for a particular item based on color at 64. Either way, the user must also select the diaper based on size at 66. The item is packed at 68 by placing it inside of the diaper, gathering the diaper around the item, and then securing the diaper with the tabs. The process ends at 70.

III. Packing Device and Method of Manufacture 102

Figure 7:
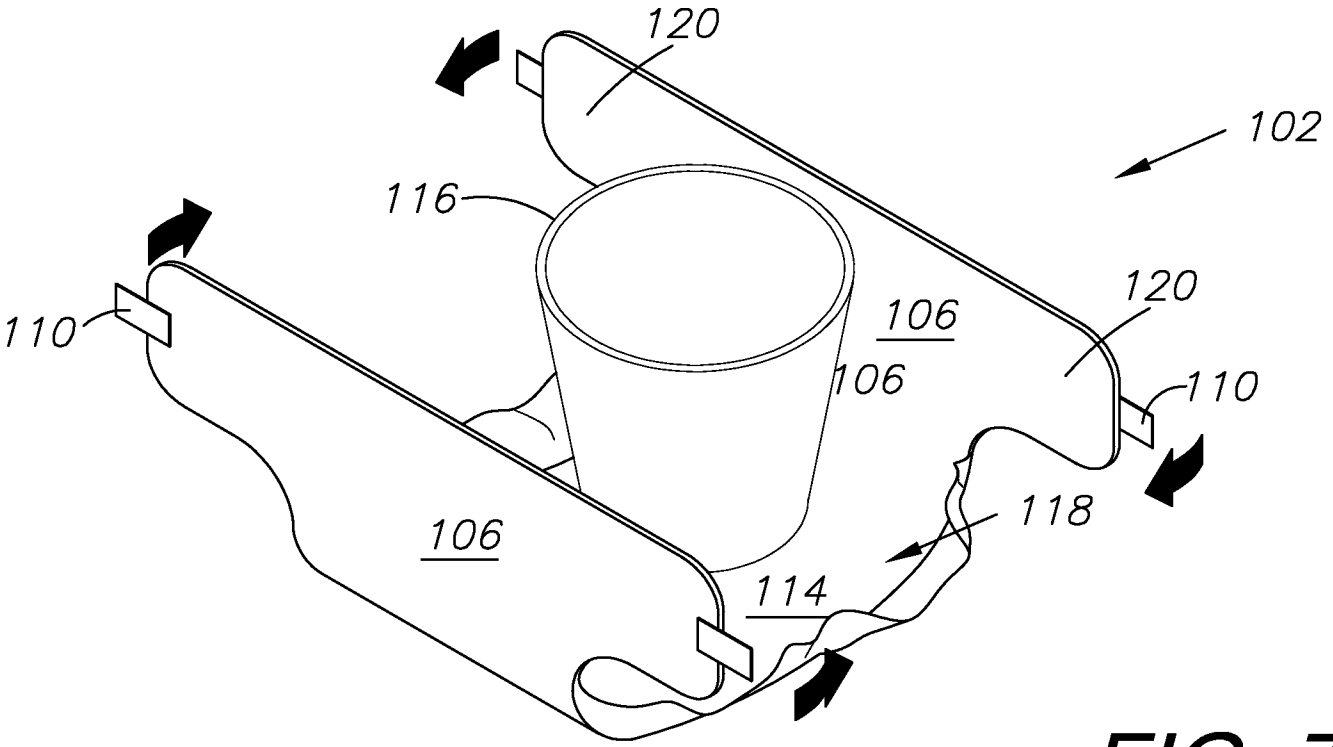
FIG. 7 is a three-dimensional isometric view thereof shown in a typical environment of packing a fragile item.
Figure 8:
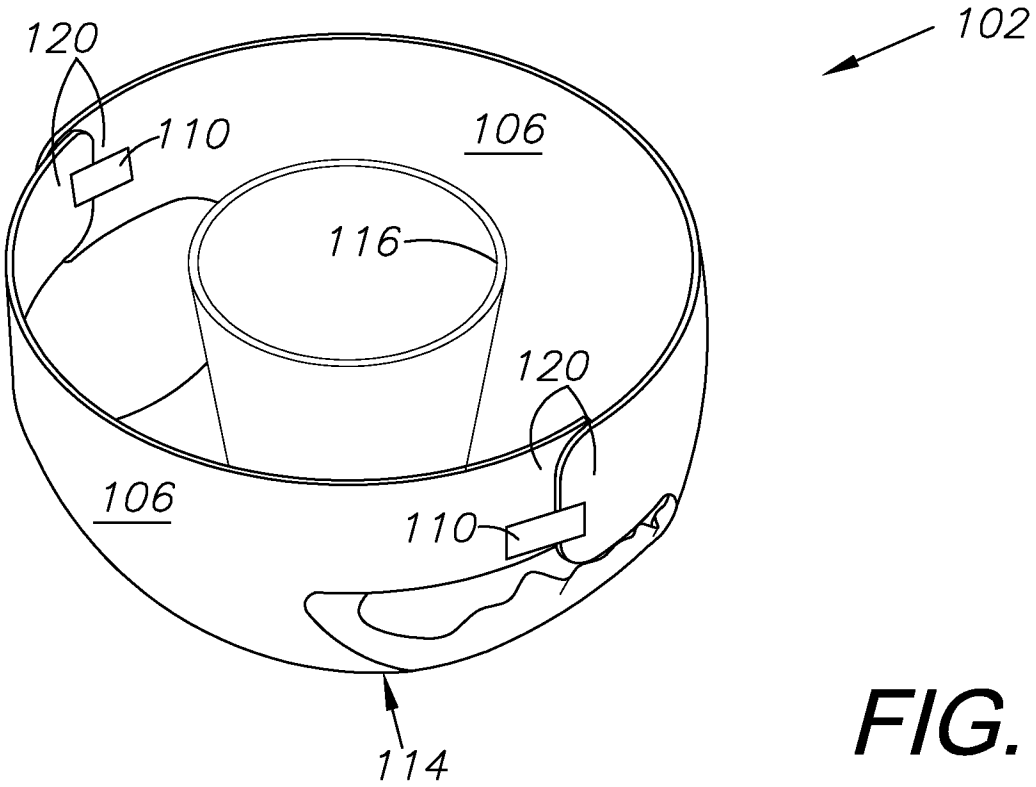
FIG. 8 is a three-dimensional isometric view thereof, showing how the embodiment thereof wraps about the fragile item.

FIGS. 5-9 show a packing device 102 manufactured for the purposes of wrapping and securing small, fragile items 116. The shape is designed similar to the shape of a diaper, having a pair of end portions 106 with flaps 120 bridged by a central portion 114 which forms a cup-like space 118 with gathered-up elastic edges 112. The body 104, formed of the end portions 106 and central portion 114, may be made of bubble wrap, foam, or other suitable packing and packaging materials. Adhesive tabs 110 at the edges of flaps 120 are used to secure the body around the packed object as shown in FIGS. 7-8. As with the previous embodiment, the entire body could also be color coded as well.

Figure 9:
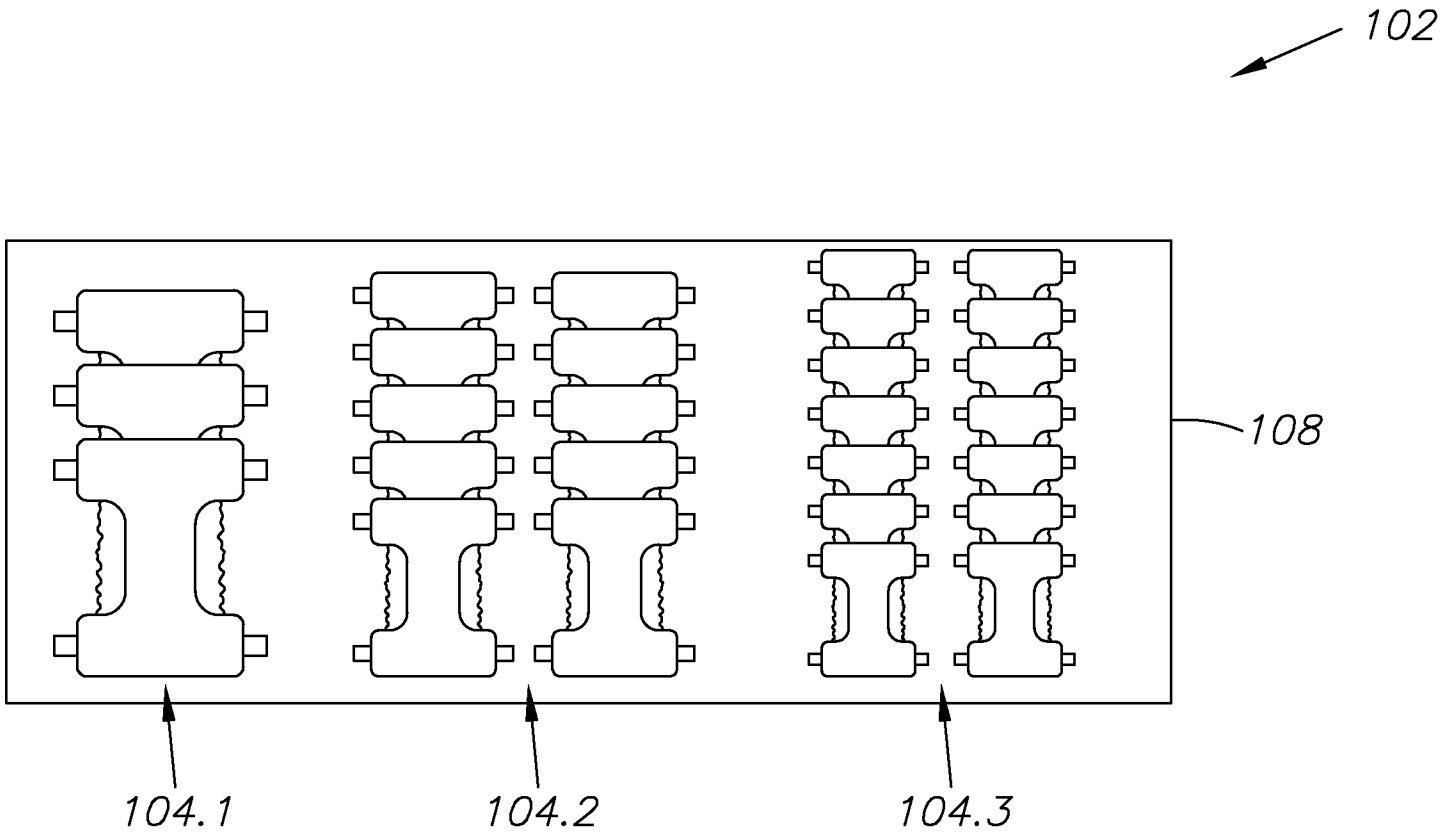
FIG. 9 is a diagrammatic representation of a packing system utilizing the embodiment thereof.

This device 102 could be employed in conjunction with the previous packing system 2 to fill in gaps in diaper supplies, or may form the entirety of a packaging kit 108 as shown in FIG. 9. As with the previous embodiment, quantities of various sizes of packing devices 104.1, 104.2, 104.3 could all be contained in a single packing kit 108.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A method of packing an object, the method comprising the steps:

providing a donation system requesting unused donated diapers;

receiving a variety of said unused donated diapers of varying sizes;

sorting said unused donated diapers;

using said unused donated diapers as packing devices, such that said variety of said unused diapers comprises a plurality of packing devices, each one of said packing devices comprising a body formed from a pair of end portions bridged by a central portion;

selecting one of said plurality of packing devices and placing the packing device about an object to be packed;

placing said object within said central portion of said packing device, wherein a pair of skirts located along sides of said central portion are gathered up and around said object;

wrapping said pair of end portions upward about said object, wherein each one of said pair of end portions comprises a pair of flaps each having an adhesive tab; and wrapping said pair of flaps of each respective one of said pair of end portions about said object and securing each of said pair of flaps using said adhesive tabs.

2. The method of claim 1, further comprising the steps:

providing a first quantity of said packing devices and a second quantity of said packing devices; and wherein the packing devices comprising said first quantity of packing devices are of a larger size than the packing devices comprising said second quantity of packing devices.

3. The method of claim 2, wherein said first quantity of packing devices are identified with a first color code and said second quantity of packing devices are identified with a second color code.

* * * * *